United States Patent [19]

Resnick et al.

[11] Patent Number: 4,775,992

[45] Date of Patent: Oct. 4, 1988

[54] CLOSED LOOP X-RAY TUBE CURRENT CONTROL

[75] Inventors: Theodore A. Resnick, Cleve Hts.; Walter A. Dupuis, Cleveland Hts., both of Ohio

[73] Assignee: Picker International, Inc., Highland Hts., Ohio

[21] Appl. No.: 909,505

[22] Filed: Sep. 19, 1986

[51] Int. Cl.[4] ..... H05G 1/34

[52] U.S. Cl. ..... 378/110; 378/109; 378/112

[58] Field of Search ..... 378/110, 109, 111, 112

[56] References Cited

U.S. PATENT DOCUMENTS

| | | | |
|---|---|---|---|
| 4,072,865 | 2/1978 | Craig et al. | 378/110 |
| 4,311,913 | 1/1982 | Resnick et al. | 250/409 |
| 4,366,575 | 12/1982 | Bax | 378/112 |
| 4,593,371 | 6/1986 | Grajewski | 364/571 |

*Primary Examiner*—Janice A. Howell
*Assistant Examiner*—David P. Porta
*Attorney, Agent, or Firm*—Fay, Sharpe, Beall, Fagan, Minnich & McKee

[57] ABSTRACT

Between scans, a stand-by control (40) causes a filament current power supply (44) to supply a low level of power to a tube filament (46). When x-rays are to be generated, a non-linear digital to analog converter (50) supplies a filament current control signal which is estimated to provide a selected tube current. A space charge compensation circuit adds an offset to the selected filament signal to compensate for the selected voltage at which the tube is to be operated. A current boost circuit (70) adds an incremental current boost (26) of a magnitude in accordance with a function of the difference between the actual filament temperature and the normal operating temperature in order to bring the filament up to operating temperature more quickly. A feedback loop (90 to 98) adjusts the selected filament current signal in accordance with any difference between the selected tube current and the actual tube current. A damping circuit (110) reduces the rate of change of the error signal such that the filament current changes at a rate commensurate with the heating rate of the filament.

22 Claims, 3 Drawing Sheets

CLOSED LOOP X-RAY TUBE CURRENT CONTROL

BACKGROUND OF THE INVENTION

The present invention relates to the electrical control arts. It finds particular application in conjunction with the precise control of tube currents in x-ray and other vacuum tubes and will be described with reference thereto. The invention finds particular application in controlling the x-ray tubes of medical diagnostic devices, such as CT scanners which require precise adherence to narrow tolerances.

Conventionally, an x-ray tube includes a thermionic filament cathode and a rotating anode which are encased in an evacuated envelope. A heating current, commonly on the order of 2–5 amps is applied through the filament to create an electron cloud therearound. A high potential, e.g. 50–150 kilovolts, is applied between the filament and the anode to accelerate the electrons from the cloud to an anode target area. This acceleration of electrons causes a tube or anode current which is commonly on the order of 5–200 milliamps. The tube current and the x-ray emitted from the anode vary with both the high potential across the tube and the temperature of the filament. The filament temperature, in turn, varies with the filament current, voltage, and internal resistance.

In CT scanners, one of a plurality of preselected voltages is applied across the anode and cathode by conventional power supply circuitry. To control the filament temperature, U.S. Pat. No. 4,311,913, issued Jan. 19, 1982 to the inventors herein, utilized a feedback loop which adjusted the filament voltage as a function of the deviation, if any, between the actual tube current and a preselected tube current. In preparation for a scan and between scans, a small stand-by filament current was applied. When a scan was to commence a high voltage was applied across the tube followed about 18 milliseconds later by closing a feedback loop to regulate the heating voltage applied to the filament as a function of the tube current. Due to cable and contact resistance, there were deviations between the regulated filament power supply output voltage and the actual filament temperature and voltage. These deviations caused inconsistency in the regulation of the filament temperature. After the scan was completed, the high tube voltage was removed and the filament current was returned to the lower stand-by current after a short post heat period.

In accordance with the present invention, a faster, more accurate x-ray tube control circuit is provided.

SUMMARY OF THE INVENTION

In accordance with one aspect of the present invention, a circuit is provided for controlling the tube current of an x-ray tube. A filament current supply means supplies a heating current to a filament of the x-ray tube. Changes in the filament heating current tend to change the filament temperature at a first, relatively slow speed. A tube current sensing means senses the actual tube current of the x-ray tube. A first feedback loop changes the filament heating current at a second, relatively fast speed in accordance with a difference between the actual tube current and a preselected tube current. The second speed is faster than the first speed such that the filament heating current tends to change too rapidly and overshoot the appropriate tube current. A damping means damps changes in the filament heating current from the second speed generally down to the first speed. In this manner, overshooting of the preselected filament heating current is inhibited.

In accordance with another aspect of the present invention, a circuit is provided for controlling the tube current of an x-ray tube. A filament current supply means supplies a heating current to a filament of the x-ray tube. A preheat current selection means causes the filament current supply means to supply a preselected pre-heat current to the filament. A sensing means senses a level of a property that varies with filament temperature, e.g. the filament voltage. A current boost means initially increases the preselected, preheat current in accordance with a thermal correction model based on variations in the level of the sensed property level. In this manner, a larger boost is provided at the beginning of a preheat cycle when the filament is cool and a smaller boost is provided when the filament is closer to the operating temperature.

In accordance with yet another aspect of the present invention, a circuit is provided for controlling the tube current of an x-ray tube. A filament current supply means supplies a heating current to a filament of the x-ray tube. A preheat current selection means provides a preheat current signal which causes the filament current supply means to supply a corresponding preselected preheat current to the filament. A space charge compensation means adds an offset to the control signal. The offset is determined in accordance with a selected operating voltage of the x-ray tube. For example, the offset may be proportional to a difference between the selected tube voltage and a preselected voltage. In this manner, the heating current applied to the filament is automatically adjusted in accordance with the operating voltage at which the tube is to be operated.

In accordance with a more limited aspect of the present invention, the above referenced x-ray tube current control circuits are utilized in conjunction with a computerized tomographic scanner to control the x-ray tube thereof.

One advantage of the present invention resides in its speed. The preferred embodiment is able to heat the filament accurately to its operating temperature in about 1 to 2 seconds.

Another advantage of the present invention resides in the improved accuracy with which the tube current is maintained. The present invention adjusts the output tube current more quickly and with less overshoot than the prior art.

Another advantage of the present invention is that it provides true secondary sensing of the filament current. By distinction, the prior art indirectly sensed the current in a primary winding of a transformer whose secondary windings controlled the filament current.

Yet another advantage of the present invention resides in a reduced sensitivity to high voltage termination resistance changes and to cable resistance.

Still further advantages of the present invention will become apparent to those of ordinary skill in the art upon reading and understanding the detailed description of the preferred embodiment.

BRIEF DESCRIPTION OF THE DRAWINGS

The invention may take form in various parts and arrangements of parts and in various steps and arrangements of steps. the drawings are only for purposes of illustrating a preferred embodiment and are not to be construed as limiting the invention.

DETAILED DESCRIPTION OF THE PREFERRED EMBODIMENT

Figure 1:
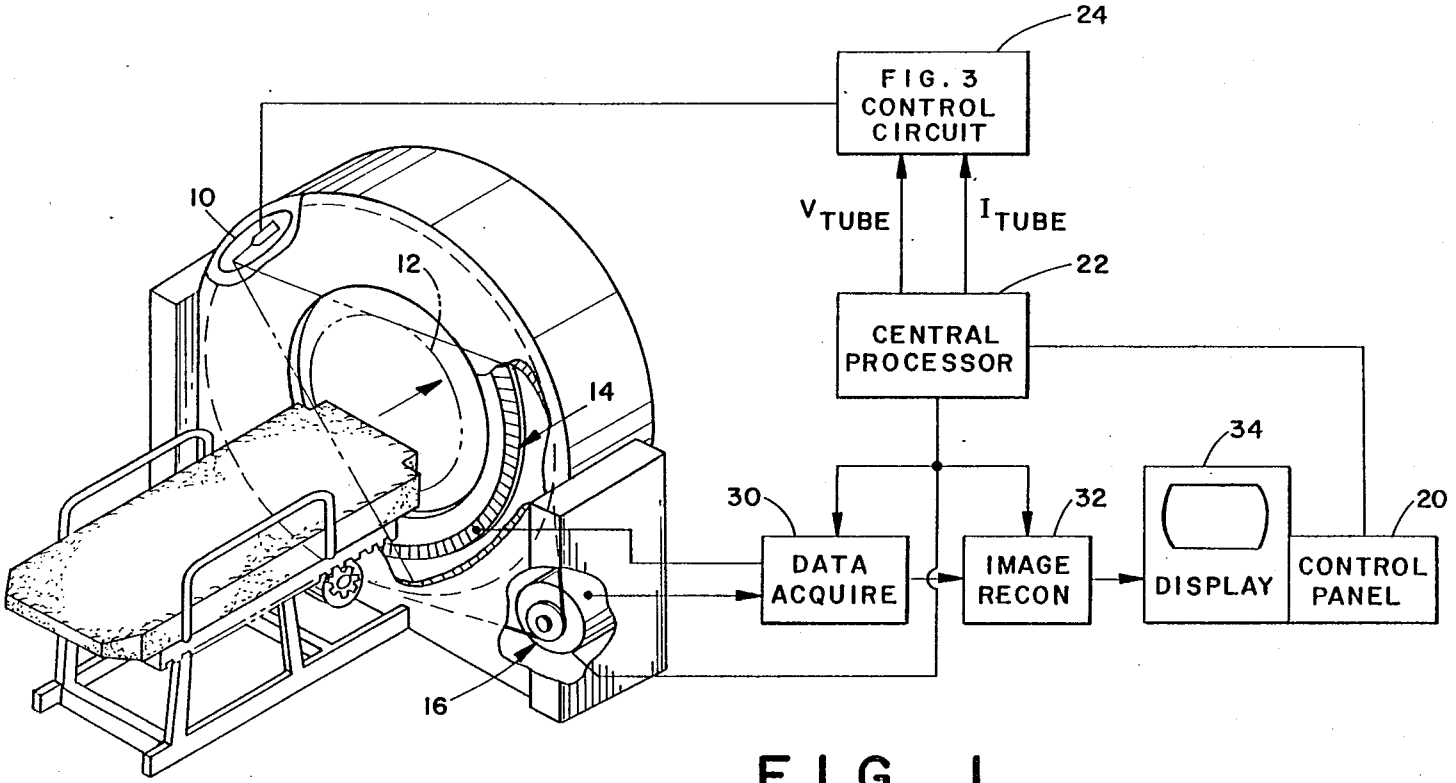
FIG. 1 is a diagrammatic illustration of a CT scanner in accordance with the present invention.

With reference to FIG. 1, a CT scanner includes an x-ray tube 10 which selectively projects a fan shaped beam of radiation across an image circle 12 to impinge upon a radiation detection means, such as an array of detectors 14. A rotating means 16 selectively causes relative rotational movement of the radiation beam around the scan circle.

A control panel 20 enables the operator to select various system controls and events. Among the controls provided on the panel is a switch or means for the operator to initiate a CT scan and means for selecting x-ray tube operating parameters including tube current and tube voltage. A central processor 22 controls the timing and operation of an x-ray tube control circuit 24 and other system components.

Figure 2:
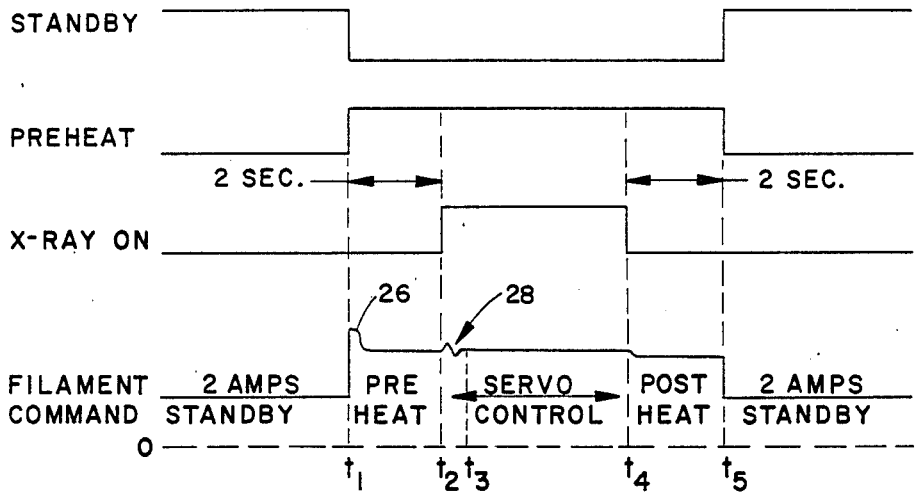
FIG. 2 is a timing diagram illustrating the timing sequence with which the x-ray tube is operated in accordance with the present invention.

With continuing reference to FIG. 1 and further reference to FIG. 2, prior to initiating a scan, the x-ray tube is in a stand-by mode. In the stand-by mode, the processor commands the control circuit to supply a filament current at a stand-by level, e.g. 2 amps.

When a scan is to start, the processor signals the tube control circuit 24 at time t1 to increase the filament current. The filament current is increased to a level which is expected to preheat the filament to a temperature which produces a selected tube current, e.g. a 4 amp filament current to produce a 200 milliamp tube current. At the beginning of the preheat mode at time t1, the filament current is boosted at 26 for a short duration to accelerate heating the filament to the operating temperature without overshooting it. The boost current, e.g. 1 amp, is selected in accordance with the difference between the actual filament temperature and its selected operating temperature. After several scans at close intervals, the filament temperature may be near the selected operating temperature and only a small or no boost current is added. After a long quiescent period, the filament may be relatively cool requiring a larger boost current. This application of a boost current which is proportionate to the difference between the actual and selected filament operating temperature enables the preheat mode to be relatively short.

At the end t2 of the preheat mode, a selected potential is applied across the tube, e.g. 150 kv. A short delay until t3, e.g. 15 milliseconds, is required for the tube current perturbations 28 to stabilize.

The central processor 22 causes the rotating means 16 to commence rotating the x-ray fan beam before the x-ray tube has stabilized at the selected operating parameters to compensate for mechanical lag. When the tube has stabilized a data acquisition means 30 collects x-ray intensity data from the x-ray detectors for reconstruction by an image processor 32 into an image representation. The image representation may be displayed on a display means 34, stored on tape or disk, or subjected to further processing.

After a scan is completed at t4, the central processor turns off the high voltage which commences a post heat mode. The tube voltage is removed and the filament current is left at an emission level sufficient to discharge the high tension cables. At the end t5 of the post heat mode, the control circuit reverts to the stand-by mode.

Figure 3:
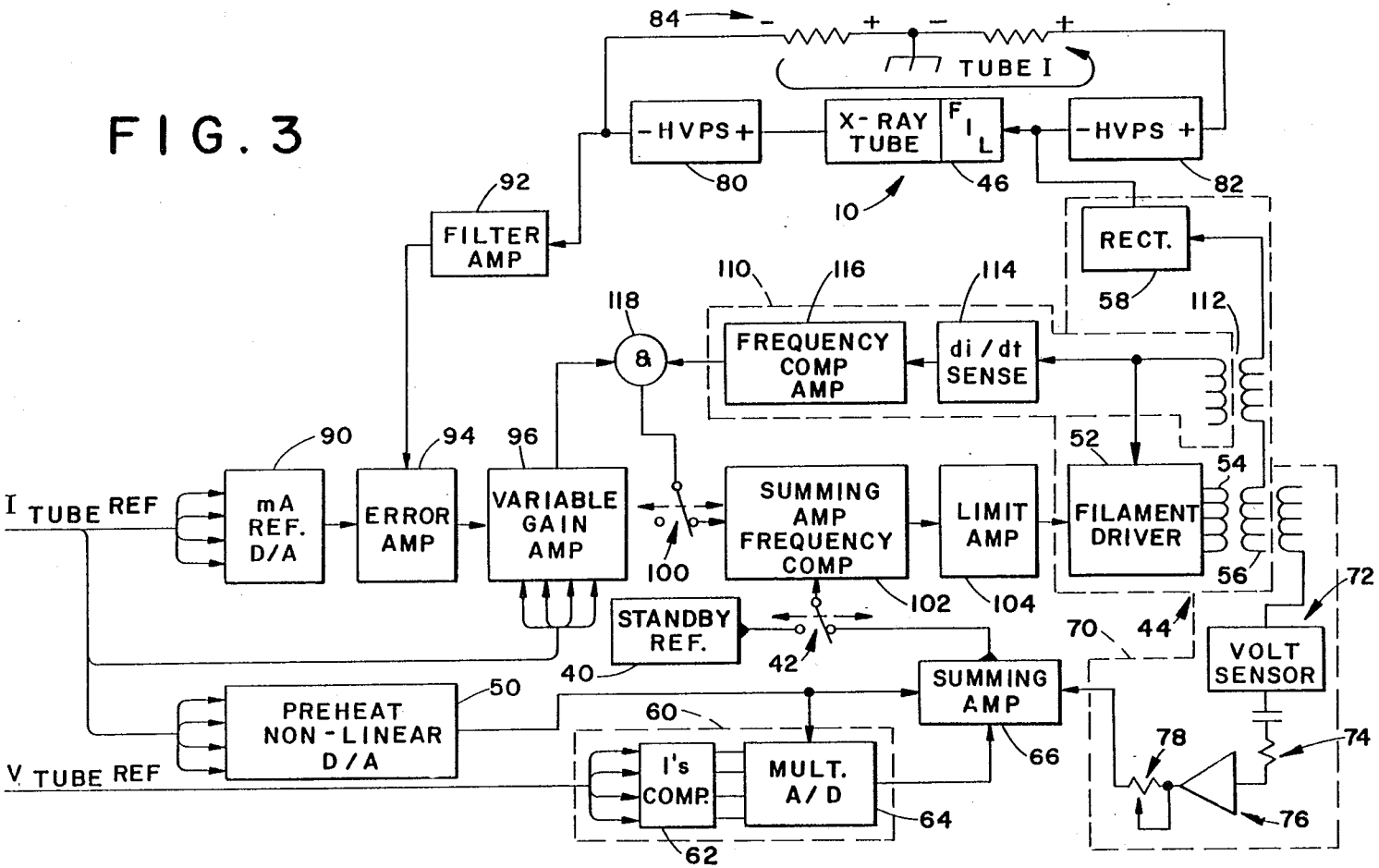
FIG. 3 is a block diagram of an x-ray tube current control circuit in accordance with the present invention.

With reference to FIG. 3, a stand-by current control 40 generates a stand-by signal which designates the preselected stand-by filament current, e.g. 2 amps. A stand-by switch 42 at times t1 and t5 switches the control circuit 24 out of and into the stand-by mode. In the stand-by mode, the stand-by switch 42 connects the current signals from the stand-by current control to a filament current supply means 44. The filament current supply means supplies the current called for by the stand-by current signal or other received current signal to a filament 46 of the tube 10.

Figure 4:
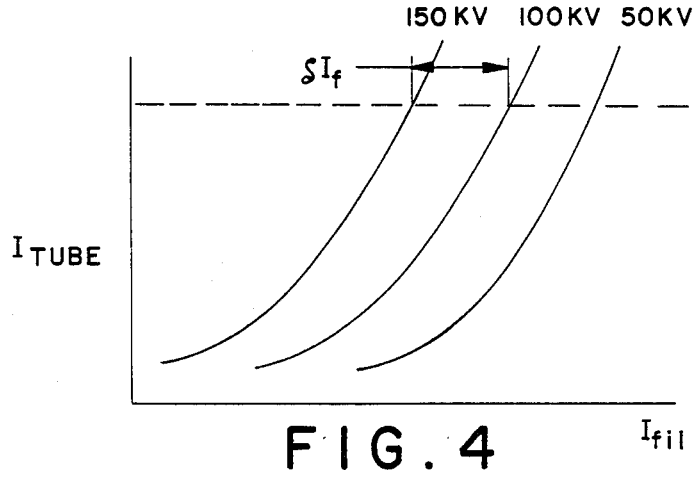
FIG. 4 illustrates tube current, filament current, and tube voltage relationships; and, FIG. 5 illustrates the improvement in the heating rate of the filament with a current boost.

The digital signal from the processor 22, indicating the selected tube current, is received by a filament current selection means 50, which computes the filament current that corresponds to the selected tube current. A non-linear digital to analog amplifier converts the digital signal indicating a milliampere range tube current into a voltage indicating an ampere range filament current. The tube to filament current relationship is based on published tube characteristics as illustrated in FIG. 4. That is, the filament current selection means produces a selected filament current signal which varies in accordance with the known exponential relationship between the tube and filament currents. In the preferred embodiment, the 150 kv curve is selected as a reference tube voltage at which to relate the tube and filament currents. This may also be achieved with appropriately selected amplifiers, loads, or with a digital look-up table.

The selected or reference filament current signal is conveyed to the filament current supply means 44 which causes the selected filament current to be supplied to the filament 46. The filament current supply means 44 includes a high frequency power supply or driver 52 that is controlled by the received current signal. The power supply provides power across a transformer primary winding 54 to a first secondary winding 56 which is connected by a rectifier 58 with the tube filament 46.

In the preferred embodiment, the x-ray tube is operable at any one of a pluality of voltages. As illustrated in FIG. 4, the tube current varies as a function of both the filament current and the tube voltage. Accordingly, the filament current required to produce a selected tube current must be changed or adjusted to compensate for different tube voltages. For a given tube voltage, the filament and tube currents vary in a generally exponential relationship. Commonly, the curves of the filament current versus the tube current for each of a family of voltages are provided in conjunction with the x-ray tube.

The preheat digital to analog converter 50 is selected to convert the selected tube current to a corresponding selected filament current for an arbitrarily selected one of the selectable tube voltages, i.e. a reference tube voltage. This enables the digital to analog converter to perform a relatively simple, non-linear conversion. This conversion might, for example, be performed by a one dimensional look-up table. If any one of N different potentials were selectable, this one dimensional look-up table could be replaced by an N dimensional look-up table. If a large number of different tube voltages might be selected, such a look-up table becomes very cumbersome. Moreover, extrapolation means might be required for extrapolating tube voltages not specifically provided in the look-up table.

The preferred embodiment performs a simpler adjustment to compensate for tube voltages. The non-linear digital to analog converter 50, as discussed above, converts the digital input tube current signal to an analog selected filament current signal in the arbitrarily selected reference tube voltage curves, i.e. 150 kv curve in the preferred embodiment. The tube voltage curves are offset from each other by a generally proportional amount along the filament current axis over the range of selectable tube currents. This filament current offset is generally proportional to the difference between the selected tube voltage and the reference tube voltage, of converter 50. That is, changing from one tube voltage to another changes the tube current to filament current relationship generally by an offset. A space charge compensation circuit means 60 receives the selected filament current signal from the filament current selection means 50 and the digital selected tube potential signal from the processor 22 and calculates the appropriate offset signal. The space charge compensation circuit includes a one's compliment circuit 62 and a multiplying digital to analog converter 64. The one's compliment circuit with the converter 64 determines the difference between the reference and selected tube voltages and multiplies the difference by the input from the non-linear converter 50. Optionally, amplifiers may be added as necessary to coordinate voltage levels. Thus, the offset is the product of the selected current signal from converter 50 and the difference between the reference and selected tube voltages. Alternately, a look-up table might be provided to determine the offset signal. The offset signal is conveyed to a combining means, including summing amplifier 66, to adjust the reference or selected filament current signal from the filament current selection means 50.

A boost circuit 70 heats the filament quickly to the desired operating temperature from a lower stand-by temperature. The filament temperature is controlled by controlling the current flowing in the filament. Simply changing the current required to maintain a stand-by temperature to a nominal current which will bring the filament temperature up to a nominal operating temperature will result in a relatively long temperature stabilization time. To reduce this stabilization time, the filament is momentarily overdriven with circuitry whose time constants are similar to those of the thermal time constant of the filament. This circuitry is implemented such that it provides a positive feedback mode of operation, based on the sensed rate of change of filament voltage. This reduces the response time of any desired change in filament operating temperature.

The current boost means 70 produces a current boost signal which varies as a function of the filament temperature. That is, the current boost control signal is greatest when the desired filament temperature changes is greatest and is the least when the filament is closest to its normal operating temperature. Because the resistance of the filament varies with its temperature, the voltage across the filament for a given filament current also varies as a function of temperature. A voltage sensor 72 includes a secondary winding of the current supply transformer which produces a signal which varies in accordance with the voltage across the x-ray tube filament, hence with its temperature and current. The sensed filament voltage is applied to an R-C circuit 74 whose time constant models the thermal response or heating speed of the tube filament. The time constant of the positive feedback boost circuit essentially compensates for the thermal time constant of the filament in the operating range. An amplifier 76 and resistor 78 convert the current from the R-C circuit to a voltage signal of the same scale as the selected current signal from the converter 50.

Figure 5:
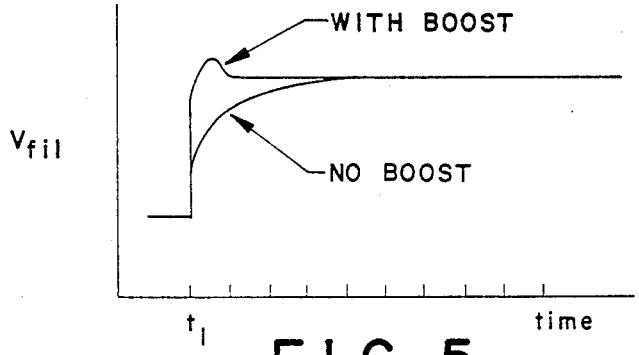

The resultant boost signal varies with both the difference between measured and selected filament voltages or temperatures and the rate of change of the measured filament voltage or temperature. This provides a time varying model which provides the optimum temperature in a minimum time. As illustrated in FIGURE 5, without the current boost, the filament voltage, hence temperature, gradually approaches the selected level. With the current boost, the filament voltage stabilizes at the selected level in a fraction of the time. For example, with a 4 amp filament current, the maximum current boost signal may cause a 1 amp additional current boost. This current boost decreases toward zero as the actual filament temperature approaches the normal operating temperature. The current boost signal is capacitively supplied such that the current boost of the selected level is applied only for a short duration, commonly a fraction of a second. The summing amplifier 66, combines the selected current signal and the current boost signal. The combined current selection signal is conveyed to the filament current supply means 44 to cause the momentary increase 26 in the filament current at the beginning t1 of the preheat cycle.

At time t2 at the end of the preheat mode, a tube voltage supply means 80, 82 applies the selected tube voltage across the x-ray tube. A tube current sensing means 84, such as a pair of resistors which complete a current loop through the tube voltage supply means and the x-ray tube, produce a voltage thereacross which varies with the tube current.

A feedback control loop causes the filament current supply means 44 to adjust the filament current in accordance with a difference between the actual, sensed tube current and a preselected tube current. More specifically, the control loop includes a digital to analog converter 90 which converts the digital tube current reference signal to an analog signal. A filter amplifier 92 scales the voltage from the tube current sensing means 84 to the same range as the analog output of the digital to analog converter 90. A comparing means, such as an error amplifier 94, determines the difference between the sensed and preselected tube currents and produces an error signal indicative thereof.

As discussed above in conjunction with the filament current selection means 50 and FIG. 4, the filament and tube currents are not linearly related but are related by a generally exponentially shaped curve. A variable amplifier 96 receives the digital, selected tube current signal and adjusts the amplification or gain of the error signal in accordance therewith.

At time t3 after the tube current perturbation 28 dies down, the processor controls a switch 100 to connect the variable gain 96 with the combining means. The combining means further includes a summing amplifier 102 which combines the selected filament current signal with the error signal. That is, when the feedback loop determines that the selected filament current is not producing the selected tube current, the selected filament current signal is adjusted upward or downward as may be appropriate to increase the filament current and, hence, the tube current or decrease the filament current, hence, the tube current. A limit amplifier 104 matches the amplitude of the error adjusted current selection signal with the filament current supply means 44 and limits the magnitudes thereof such that the filament current supply means cannot be called upon to deliver unacceptably high current levels to the filament.

A damping means 110 damps changes in the filament current such that the filament current changes at about the heating rate of the filament. That is, if the filament current attempts to increase suddenly, the filament temperature will not jump correspondingly. Rather, the filament current and therefore temperature are constrained to increase along a smooth, generally exponential curve. Thus, the temperature of the filament changes at a first, generally low speed. Because the first feedback loop is configured of relatively high speed solid state components, the feedback loop makes error adjustments at a second, relatively fast speed. This difference in the speeds of the feedback loop and the filament can cause overshooting of the appropriate filament current. Note for example, if the tube current is lower than the preselected current, the first feedback loop will cause the current selection signal to be increased correspondingly. However, even if the filament current is increased by this amount, the slower heating speed of the filament will cause an apparent error to persist. The first feedback loop will sense this error and increase the filament current yet more. This increasing of the filament current will continue until the limit of the limit amplifier 104 is reached. When the tube current reaches the preselected current, the filament current will be too high which causes the filament to continue heating, overshooting its mark. Thereafter, the relatively slow cooling rate of the filament causes a corresponding overshooting problem in the other direction. The damping means 110 causes the filament current to increase generally at the first filament heating speed by supplying a damping signal which reduces the response rate of the feedback loop.

The damping means includes a transformer 112 and a rate of change sensing means 114 which senses changes in the filament current between the secondary coil 56 and the rectifier 58. Part of the sensed rate of signal is fed back to the high frequency driver 52 of the current supply means 44. The sensed rate of filament current change signal is also converted by the rate of change sensing means 114 into a voltage signal of the same scale as the error signal and the current selection signal. A frequency compensation circuit 116 shapes the high frequency components to provide an analog damping signal. The combining means includes a summing point 118 that combines the damping signal with the error signal such that the rate of change of the error signal, hence the filament current, is damped.

The invention has been described with reference to the preferred embodiment. Obviously, modifications and alterations will occur to others upon reading and understanding the preceding detailed description of the preferred embodiment. It is intended that the invention be construed as including all such modifications and alterations insofar as they come within the scope of the appended claims or the equivalents thereof.

Having thus described the preferred embodiment, the invention is now claimed to be:

1. A circuit for controlling tube current of an x-ray tube, the circuit comprising:

a filament current supply means for supplying a current to a filament of the x-ray tube to heat the filament, changes in the filament current tending to change the filament heating at a first, relatively slow speed;

a tube current sensing means for sensing actual tube current of the x-ray tube;

a feedback loop means for changing the filament current supplied by the filament current supply means at a second, relatively fast speed in accordance with a difference between the actual tube current sensed by the tube current sensing means and a preselected tube current, the second speed being faster than the first speed;

a means for sensing a rate of change of the filament current; and, a means for feeding a damping signal indicative of the sensed rate of change to the first feedback loop means, such that the filament current is constrained to change generally at the heating speed of the filament.

2. The circuit as set forth in claim 1 wherein the first feedback loop derives an error signal which varies in accordance with the difference between the actual and preselected tube currents and wherein the damping signal and the error signal are combined, such that the damping signal reduces the magnitude of the error signal in accordance with the rate of filament current change.

3. The circuit as set forth in claim 2 further including a current selection means for generating a selected filament current signal which varies in accordance with a preselected filament current, the preselected filament current signal being combined with the error signal and the damping signal, whereby the selected filament current signal generally sets the filament current, the error signal adjusts the selected filament current as appropriate to bring the actual tube current to a selected level, and the damping signal controls the rate at which the filament current is changed.

4. The circuit as set forth in claim 3 further including means for adding an offset to the preselected filament current signal, the offset having a magnitude in accordance with a selected voltage to be applied across the tube.

5. The circuit as set forth in claim 3 further including a filament current boost means for boosting the filament current at the beginning of a filament heating cycle.

6. The circuit as set forth in claim 5 wherein the boost means senses a voltage across the filament and generates a boost signal which varies generally with a rate of change of the sensed filament voltage, the boost signal being combined with the preselected filament current signal.

7. The circuit as set forth in claim 3 further including a plurality of radiation detectors for detecting x-rays emitted by the tube, and an image reconstruction means for constructing an image representation from the intensity of x-rays received by the x-ray detecting means.

8. A circuit for controlling tube current of an x-ray tube, the circuit comprising:

a filament current supply means for supplying a heating current to a filament of the x-ray tube;

a current selection means for causing the filament current supply means to supply a preselected current to the filament;

a sensing means for sensing a level of a property of the x-ray tube that varies with filament temperature; and, a current boost means for boosting the heating current only as the filament is initially heated toward a selected operating temperature by an amount which varies with a difference between the sensed property level and a property level indicative of the selected operating temperature of the filament.

9. A circuit for controlling tube current of an x-ray tube, the circuit comprising:

a current selection means for generating a selected current signal;

a filament current supply means for supplying a heating current to a filament of the x-ray tube in accordance with the selected current signal, the filament current supply means being operatively connected with the current selection means to receive the selected current signal therefrom;

a filament temperature sensing means for sensing a property that changes with filament temperature ; and, a boost signal generating means for generating a boost signal which varies with a size and rate of the change of the sensed filament temperature property, the boost signal generating means being operatively connected with the current selection means and with the filament current supply means such that the heating current is boosted in accordance with a combination of the boost signal and the selected current signal to accelerate filament heating.

10. The circuit as set forth in claim 9 further including means for adding an offset to the selected filament current signal, the offset varying in accordance with a selected voltage to be applied across the tube.

11. The circuit as set forth in claim 9 further including:

means for sensing actual tube current;

a comparing means for comparing the sensed tube current with a preselected tube current, the comparing means generating an error signal which varies with the difference between the preselected and sensed tube currents; and, a summing means for summing the error signal with the selected current signal.

12. The circuit as set forth in claim 11 further including means for sensing a rate of change of the filament current and a damping signal means for generating a damping signal which varies in accordance with the sensed rate of change, the damping signal means being operatively connected with the summing means for combining the damping signal with the error and selected current signals.

13. A circuit for controlling tube current of an x-ray tube, the circuit comprising:

a filament current supply means for supplying a heating current to a filament of the x-ray tube;

a current selection means for generating a selected current signal which directs the filament current supply means to supply a selected current to the filament;

a space charge compensation means for deriving an offset signal in accordance with the selected filament current and a selected operating voltage of the x-ray tube; and, a means for combining the offset signal with the selected current signal.

14. The circuit as set forth in claim 13 wherein the space charge compensation means includes means for combining the selected current signal with a signal representative of a selected tube voltage to produce the offset signal.

15. The circuit as set forth in claim 13 further including a filament current boost means for generating a boost signal at the beginning of a filament heating cycle, the boost means being operatively connected with the combining means to supply the boost signal thereto.

16. A circuit for controlling tube current of an x-ray tube, the circuit comprising:

a filament current supply means for supplying a heating current to a filament of the x-ray tube;

a current selection means for generating a selected filament current signal which directs the filament current supply means to supply a selected filament current to the filament;

means for sensing actual tube current;

a comparing means for comparing the sensed tube current with a preselected tube current, the comparing means generating an error signal which varies with the difference between the preselected and sensed tube currents, the comparing means being connected with a combining means to combine the error signal with the selected filament current signal; and, a damping means for sensing a rate of change of the filament current and for generating a damping signal which varies in accordance with the sensed filament current change, the damping means being operatively connected with the combining means for combining the damping signal with the error and preselected current signals.

17. A CT scanner for generating an image representation representing at least one planar slice through an imaged subject, the scanner comprising:

an x-ray tube for generating a fan shaped beam of radiation through a scan circle;

a radiation detection means disposed opposite the scan circle from the x-ray tube for receiving the radiation;

a moving means for moving the radiation beam relative to the scan circle to irradiate the subject from a plurality of directions;

an image reconstruction means for reconstructing an image representation in accordance with intensity of radiation impinging upon the radiation detection means; and, a circuit for controlling tube current of the x-ray tube, the circuit comprising:

a filament current supply means for supplying a heating current to a filament of the x-ray tube to heat the filament, changes in the filament current tending to change the filament heating at a relatively slow filament heating speed;

a tube current sensing means for sensing actual tube current of the x-ray tube;

a feedback loop means for changing the filament current supplied by the filament current supply means at a relatively fast feedback loop reacting speed in accordance with a difference between the actual tube current sensed by the tube current sensing means and a preselected tube current, the feedback loop reaction speed being faster than the filament heating speed; and, a damping means for limiting a rate of change in the filament heating current generally to the filament heating speed.

18. A CT scanner for generating an image representation representing at least one planar slice through an imaged subject, the scanner comprising:

an x-ray tube for generating a fan shaped beam of radiation through a scan circle;

a radiation detection means disposed opposite the scan circle from the x-ray tube for receiving the radiation;

a moving means for moving the radiation beam relative to the scan circle to irradiate the subject from a plurality of directions;

an image reconstruction means for reconstructing an image representation in accordance with intensity of radiation impinging upon the radiation detection means; and, a circuit for controlling tube current of the x-ray tube, the circuit comprising:

a filament current supply means for supplying a heating current to a filament of the x-ray tube to heat the filament;

a current selection means for causing the filament current supply means to supply a preselected current to the filament;

a sensing means for sensing a level of a property of the x-ray tube that varies with filament temperature;

a feedback loop means for controlling the filament current supply means in accordance with variations between the sensed temperature and a selected temperature; and, a current boost means for boosting the preselected current by an amount which varies with a difference between the sensed property level and a property level indicative of a selected operating temperature of the filament and the rate of change of said difference.

19. A CT scanner for generating an image representation representing at least one planar slice through an imaged subject, the scanner comprising:

an x-ray tube for generating a fan shaped beam of radiation through a scan circle;

a radiation detection means disposed opposite the scan circle from the x-ray tube for receiving the radiation;

a moving means for moving the radiation beam tube relative to the scan circle to irradiate the subject from a plurality of directions;

an image reconstruction means for reconstructing an image representation in accordance with an intensity of radiation impinging upon the radiation detection means; and, a circuit for controlling tube current of the x-ray tube, the circuit comprising:

a filament current supply means for supplying a heating current to a filament of the x-ray tube;

a current selection means for generating a selected current signal which directs the filament current supply means to supply a selected current to the filament;

a space charge compensation means for deriving an offset signal in accordance with the selected current signal and a selected operating voltage of the x-ray tube; and, a means for combining the offset signal with the selected current signal.

20. A method for controlling a tube current of an x-ray tube, the method comprising:

supplying a heating current to a filament of the tube;

sensing an actual tube current through the tube;

comparing the sensed tube current with a preselected tube current to generate an error signal indicative of an error therebetween;

sensing a rate of change of the filament current;

reducing the error signal in accordance with the sensed rate of change of the filament current; and, altering the filament current in accordance with the error signal, such that the rate of change of the filament current is damped.

21. A method for controlling a tube current of an x-ray tube, the method comprising:

generating a selected current signal indicative of a preselected filament current;

supplying a heating current in accordance with the selected current signal to a filament of the x-ray tube;

sensing a property of the tube that varies with the temperature of the x-ray tube filament;

initially boosting the filament current in accordance with the difference between the sensed filament temperature property and a preselected filament temperature property; and, thereafter, controlling the filament current in accordance with a feedback loop signal.

22. A method for controlling a tube current of an x-ray tube, the method comprising:

generating a selected filament current signal indicative of a preselected filament current;

deriving an offset signal in accordance with the selected filament current and a selected tube voltage;

combining the offset signal with the selected filament current signal; and, supplying a heating current to a filament of the x-ray tube in accordance with the combined offset and selected filament current signal.

* * * * *